US010004333B2

(12) United States Patent
Mackert

(10) Patent No.: US 10,004,333 B2
(45) Date of Patent: Jun. 26, 2018

(54) ITEM OF SEATING FURNITURE WITH A SPRING-MOUNTED BACKREST

(71) Applicant: Innotec Motion GmbH, Lippstadt (DE)

(72) Inventor: Michael Mackert, Ruethen (DE)

(73) Assignee: INNOTEC MOTION GMBH, Lippstadt (DE)

( * ) Notice: Subject to any disclaimer, the term of this patent is extended or adjusted under 35 U.S.C. 154(b) by 0 days. days.

(21) Appl. No.: 15/100,426

(22) PCT Filed: Apr. 15, 2014

(86) PCT No.: PCT/EP2014/057660
§ 371 (c)(1),
(2) Date: May 31, 2016

(87) PCT Pub. No.: WO2014/106673
PCT Pub. Date: Jul. 10, 2014

(65) Prior Publication Data

US 2016/0302572 A1 Oct. 20, 2016

(30) Foreign Application Priority Data

Jan. 8, 2014 (DE) ..... 20 2014 100 062 U

(51) Int. Cl.
*A47C 1/024* (2006.01)
*A47C 3/026* (2006.01)
(Continued)

(52) U.S. Cl.
CPC ..... *A47C 1/024* (2013.01); *A47C 1/0246* (2013.01); *A47C 1/035* (2013.01); *A47C 1/036* (2013.01);
(Continued)

(58) Field of Classification Search
CPC ..... A47C 1/024; A47C 1/0246; A47C 1/036; A47C 1/03266; A47C 1/03272; A47C 1/035; A47C 7/506
(Continued)

(56) References Cited

U.S. PATENT DOCUMENTS 2,140,058 A * 12/1938 Sheldrick ..... A47C 7/441 297/301.4
2,398,072 A * 4/1946 Boerner ..... A47C 1/025 297/301.4
(Continued)

FOREIGN PATENT DOCUMENTS

CN 101161159 A 4/2008
DE 3513336 A1 10/1986
(Continued)

OTHER PUBLICATIONS

International Search Report, WO2014/106673 A3 , dated Jul. 29, 2014.

*Primary Examiner* — Rodney B White
(74) *Attorney, Agent, or Firm* — Cohen & Hildebrand, PLLC

(57) ABSTRACT

An item of seating furniture (100), with backrest (101), seat surface (102), supporting structure and resetting mechanism (200), wherein the backrest (101) and the seat surface (102) are connected to the supporting structure. The backrest (101) is pivotable relative to the supporting structure about a pivot axis from a first position into a second position, and the backrest (101) is connected to the seat surface (102) via connector (103). The connector (103) is designed such that, when the backrest (101) pivots relative to the seat surface, the seat surface (102) is inclined relative to the supporting structure, wherein the resetting mechanism (200) are designed to exert a resetting force on the backrest (101) in the second position, the resetting force is directed in the
(Continued)

direction of the first position, wherein the item of seating furniture (100) with setting mechanism (104) which is designed to set the resetting force.

11 Claims, 9 Drawing Sheets

(51) Int. Cl.
*A47C 1/036* (2006.01)
*A47C 1/032* (2006.01)
*A47C 1/035* (2006.01)
*A47C 7/50* (2006.01)

(52) U.S. Cl.
CPC ..... *A47C 1/03266* (2013.01); *A47C 1/03272* (2013.01); *A47C 7/506* (2013.01)

(58) Field of Classification Search
USPC .... 297/285–299, 300.5, 300.6, 300.7, 300.8, 297/423.26, 423.28
See application file for complete search history.

(56) References Cited

U.S. PATENT DOCUMENTS 2,456,797 A * 12/1948 Sheldrick ..... A47C 7/441 297/300.5
2,662,586 A * 12/1953 Cramer ..... A47C 1/0246 297/291
2,770,292 A * 11/1956 Hamilton ..... A47C 3/18 297/301.4
3,042,448 A * 7/1962 Hamilton ..... A47C 3/026 297/300.5
3,441,311 A * 4/1969 Doerner ..... A47C 3/026 297/301.4
3,712,672 A * 1/1973 De Graaf ..... A47C 1/0246 297/301.4
4,451,085 A * 5/1984 Franck ..... A47C 1/03255 297/285
4,479,679 A * 10/1984 Fries ..... A47C 1/03255 297/300.5
4,761,033 A 8/1988 Lanuzzi et al.
4,988,145 A * 1/1991 Engel ..... A47C 1/03255 297/300.4
5,080,318 A 1/1992 Takamatsu et al.
5,547,252 A 8/1996 Pfenniger
5,782,535 A * 7/1998 Lafer ..... A47C 1/0342 297/423.28
6,003,943 A 12/1999 Schneider
6,036,268 A * 3/2000 Larson ..... A47C 7/506 297/423.26 X
6,120,096 A * 9/2000 Miotto ..... A47C 1/03255 297/300.5 X
6,174,031 B1 1/2001 Lindgren et al.
6,196,631 B1 * 3/2001 Larson ..... A47C 7/506 297/423.26
6,213,552 B1 * 4/2001 Miotto ..... A47C 1/03238 297/300.5
6,238,000 B1 * 5/2001 Hallmark ..... A47C 1/03238 297/300.5
6,932,431 B2 * 8/2005 Koch ..... A47C 1/024 297/301.4
7,249,801 B2 * 7/2007 Tonin ..... A47C 7/445 297/300.5 X
7,281,764 B2 * 10/2007 Thole ..... A47C 1/03255 297/300.5
8,646,839 B2 * 2/2014 Moreschi ..... A47C 1/03255 297/300.5 X
8,998,322 B2 * 4/2015 Horiki ..... A47C 1/03255 297/300.5 X
2004/0004380 A1 * 1/2004 Horiki ..... A47C 1/03255 297/300.5
2004/0130197 A1 * 7/2004 Costaglia ..... A47C 1/03238 297/300.5
2009/0066134 A1 * 3/2009 Bock ..... A47C 1/024 297/301.3
2010/0096894 A1 * 4/2010 Fukai ..... A47C 1/032 297/300.5
2010/0244522 A1 * 9/2010 Fukai ..... A47C 1/032 297/300.5 X
2011/0074197 A1 * 3/2011 Okamoto ..... A47C 1/03238 297/300.6
2011/0181086 A1 * 7/2011 Pfeifer ..... A47C 1/03255 297/300.1
2012/0256458 A1 10/2012 Gehner et al.
2016/0192782 A1 * 7/2016 He ..... A47C 1/03272 297/285

FOREIGN PATENT DOCUMENTS

DE 4327373 A1 2/1995
DE 69028500 T2 1/1997
DE 69600110 T2 11/1997
DE 10147548 C1 * 11/2002 ..... A47C 1/03233
DE 10219478 A1 11/2003
DE 102008037857 A1 * 2/2010 ..... A47C 1/03255
EP 0247311 B1 3/1991
EP 1911371 A 4/2008
EP 2508102 A1 10/2012
GB 2246287 A 1/1992
TW 429423 M 5/2012

* cited by examiner

ITEM OF SEATING FURNITURE WITH A SPRING-MOUNTED BACKREST

This is an application filed under 35 USC § 371 of PCT/EP2014/057660, filed on Apr. 15, 2014 claiming priority to DE 20 2014 100 062.3, filed on Jan. 8, 2014, each of which is herein incorporated by reference in its entirety.

BACKGROUND OF THE INVENTION

The present invention relates to an item of seating furniture with a spring-mounted backrest.

Items of seating furniture with a spring-mounted backrest are known from the prior art. In the case of what are referred to as relaxing chairs, a user can loan with his weight against the backrest such that the latter is inclined rearwards and takes up a more pleasant position for the user. The backrest here is connected via a linkage to the seat surface in such a manner that the seat surface is inclined relative to a supporting structure. If the user by means of his bodyweight moves the backrest rearwards, the seat surface is inclined in such a manner that the bearing surface of the user's posterior is located lower than the bearing surface of the thighs. The seat, surface therefore slopes towards the backrest.

During the movement of the backrest, resetting means exert a resetting force on the backrest, said resetting force being directed counter to the force exerted by the user. The resetting force ensures that the backrest is moved again into the starting position when the force exerted by the user ceases, i.e. when the user moves forwards again.

Different user weights mean that the resetting force is perceived to be well-balanced only by a few users. Heavy users perceive the resetting force to be too low, whereas light users perceive the resetting force to be too high. Therefore, a light user may move the backrest rearwards only by great effort, whereas a heavy user by means of his weight moves the backrest rearwards even if he does not desire this at all.

By contrast, the invention is based on the object of providing an item of seating furniture with a greater degree of comfort for users of differing weight.

BRIEF SUMMARY OF THE INVENTION

This object is achieved by an item of seating furniture with the features of Claim 1. Embodiments of the invention are indicated in the dependent claims.

According to Claim 1, the item of seating furniture comprises setting means which are designed to set the resetting force. A user can set the resetting force according to his requirements by using the setting means. For example, a relatively heavy user can set a relatively high resetting force, and therefore said user has to apply a relatively high force in order to move the backrest rearwards. The relatively heavy user will not find this difficult because of his weight. The same item of seating furniture also provides a high level of comfort for a relatively light user. The relatively light user can use the setting means to set a relatively low resetting force, and therefore said user has no problem in moving the backrest rearwards counter to the resetting force.

According to one embodiment of the invention, the resetting means can be supported on the seat surface. The term "seat surface" is understood here as meaning, in particular, supporting components and the bearing surface for the user's posterior and for at least part of the thighs. The supporting components can be connected directly or indirectly to the bearing surface. The supporting components are immovable here relative to the bearing surface. The entire seat surface can therefore only be moved as a whole relative to the backrest and/or to the supporting structure of the item of seating furniture. The term "supporting structure" is understood here as meaning, in particular, components which support the seat surface and also components which support the backrest. The supporting structure may also be referred to as the base. The supporting structure may comprise standing means which are designed to stand the item of seating furniture on a flat surface.

In addition, the resetting means can be connected to the connecting means. The resetting force can be exerted on the backrest via the connecting means, for example a linkage.

During use of the item of seating furniture as intended, the resetting means can be arranged in particular below the seat surface. The resetting means can be supported in particular on an end region of the seat surface that faces the backrest.

According to one embodiment of the invention, the it era of seating furniture can comprise a footrest which is pivotable into a region below the seat surface. Such a footrest is advantageous for an even higher level of comfort of the item of seating furniture. In particular when the user has leaned rearwards, the foot rest can support the legs and/or feet of the user. The footrest can be coupled mechanically to the seat surface and/or the backrest in such a manner that, when the backrest moves from the first position into the second position, i.e. rearwards, the footrest under the seat surface is swung away upwards and is suitable for supporting the legs and/or the feet of the user. When the backrest moves into the first position, the footrest can be swung under the seat surface such that it does not annoy a user. In this connection, it is particularly advantageous if the resetting means are supported in the end region of the seat surface. This is because sufficient space then remains below the seat surface for the swung-in footrest.

According to one embodiment of the invention, the connecting means can comprise a linkage. This linkage may also be referred to as a lever mechanism which couples the movement of the backrest to the movement of the seat surface.

According to one embodiment of the invention, the resetting means can be designed to exert the resetting force on the backrest during the entire pivoting operation of the backrest.

According to one embodiment of the invention, the resetting means can comprise a spring.

According to one embodiment of the invention, the spring can have a pretension. The pretension can be set by the setting means.

According to one embodiment, of the invention, the setting means can comprise a threaded rod and a gripping means which is screwable onto the threaded rod. The pretension can be set by the extent to which the gripping means is screwed onto the threaded rod. This is a particularly convenient manner for the user of setting the resetting force.

According to one embodiment of the invention, the threaded rod can have a left-handed thread. This is advantageous in particular if the setting means are arranged below the seat surface during use of the item of seating furniture as intended. Tests have shown that, by means of the fitting below the seat surface, most users experience an increase in the resetting force upon a rotation in the clockwise direction. This can be achieved by a left-handed thread.

According to one embodiment of the invention, the threaded rod can have a trapezoidal thread. The relatively large pitch of the trapezoidal thread is an advantage so that the desired resetting force can be set by relatively few revolutions.

According to one embodiment of the invention, the spring can be designed as a helical spring with a plurality of turns. The number of turns per length unit can be inconstant here. As a result, different resetting forces can be set by means of the threaded rod and the gripping means.

According to one embodiment of the invention, the number of turns of the spring per length unit increase continuously from one end to another end of the spring. Depending on the extent to which the gripping means has been screwed onto the threaded rod the spring is pretensioned to a greater or lesser extent. Different, resetting forces can thus be achieved by the continuous increase in the turns per length unit.

According to one embodiment of the invention, the turns can have different radii of curvature. This can likewise contribute to different resetting forces being able to be set particularly easily.

According to one embodiment of the invention, the radii of curvature can increase continuously from one end to the other end of the spring. In this case, the shape of the spring may also be referred to as conical.

The invention is described in more detail with reference to the attached figures, in which:

DETAILED DESCRIPTION OF THE INVENTION

Figure 1A:
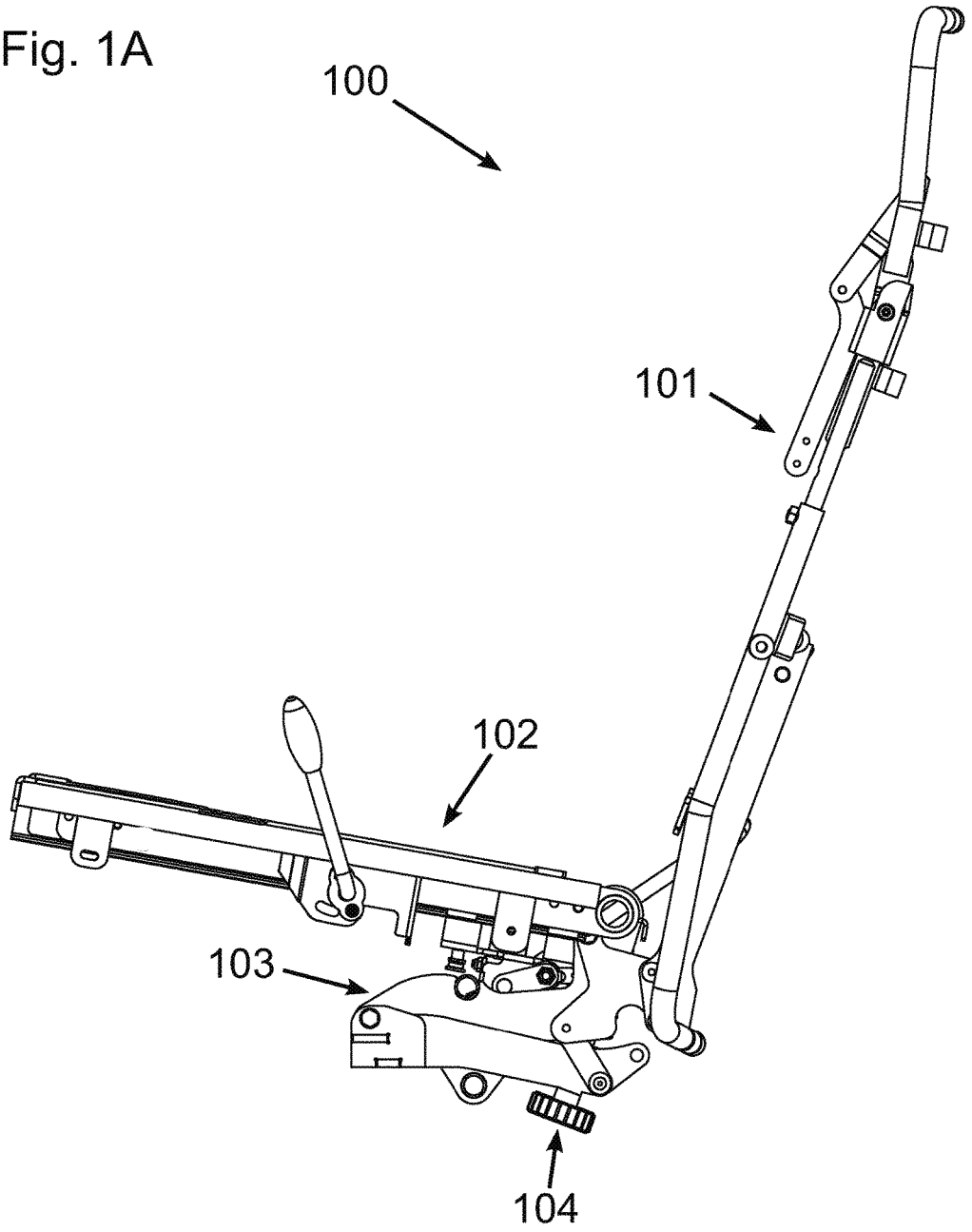
FIGS. 1A-1E show schematic illustrations of an item of seating furniture according to one embodiment of the invention in various positions.
Figure 1B:
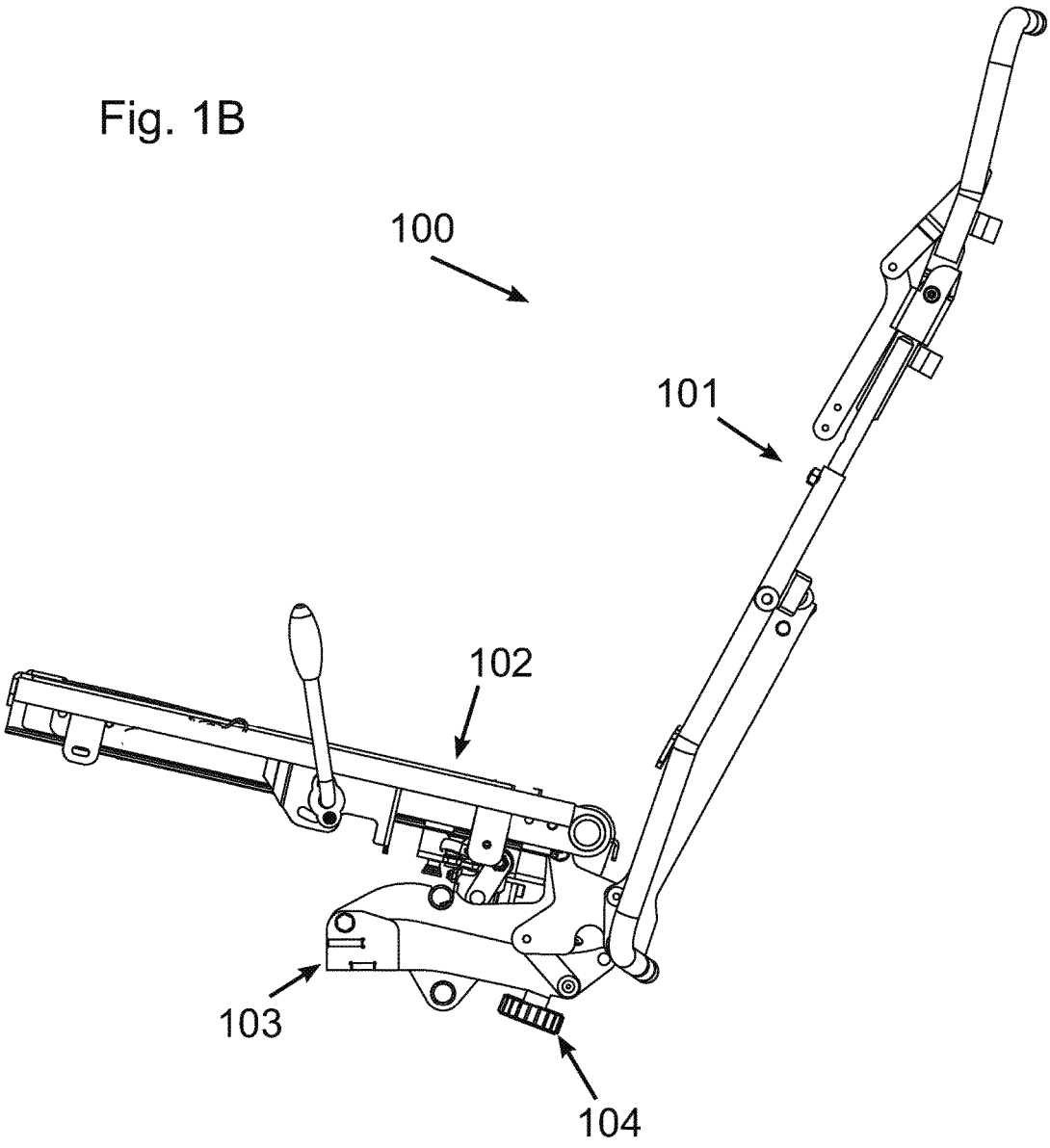
Figure 1C:
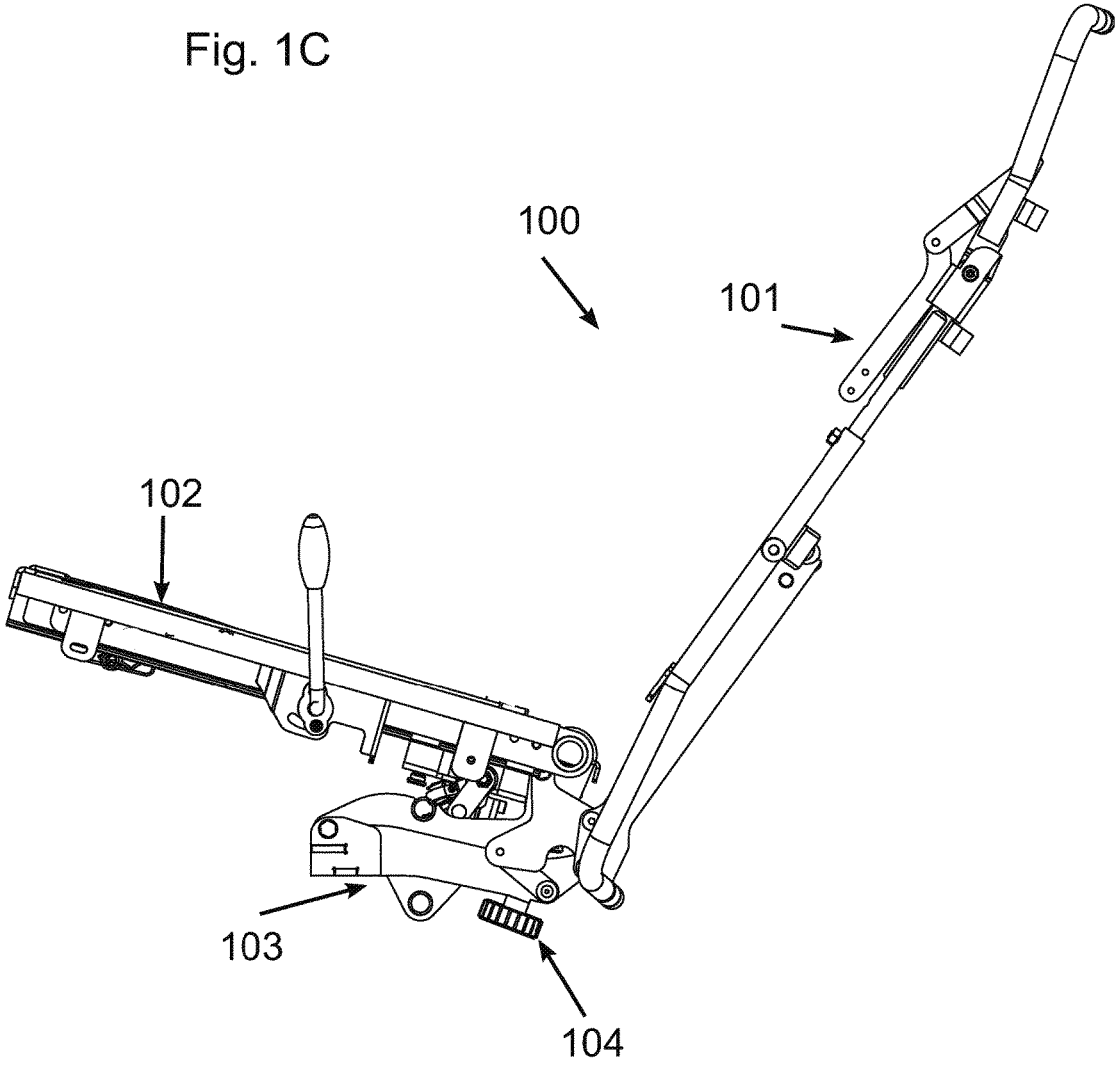
Figure 1D:
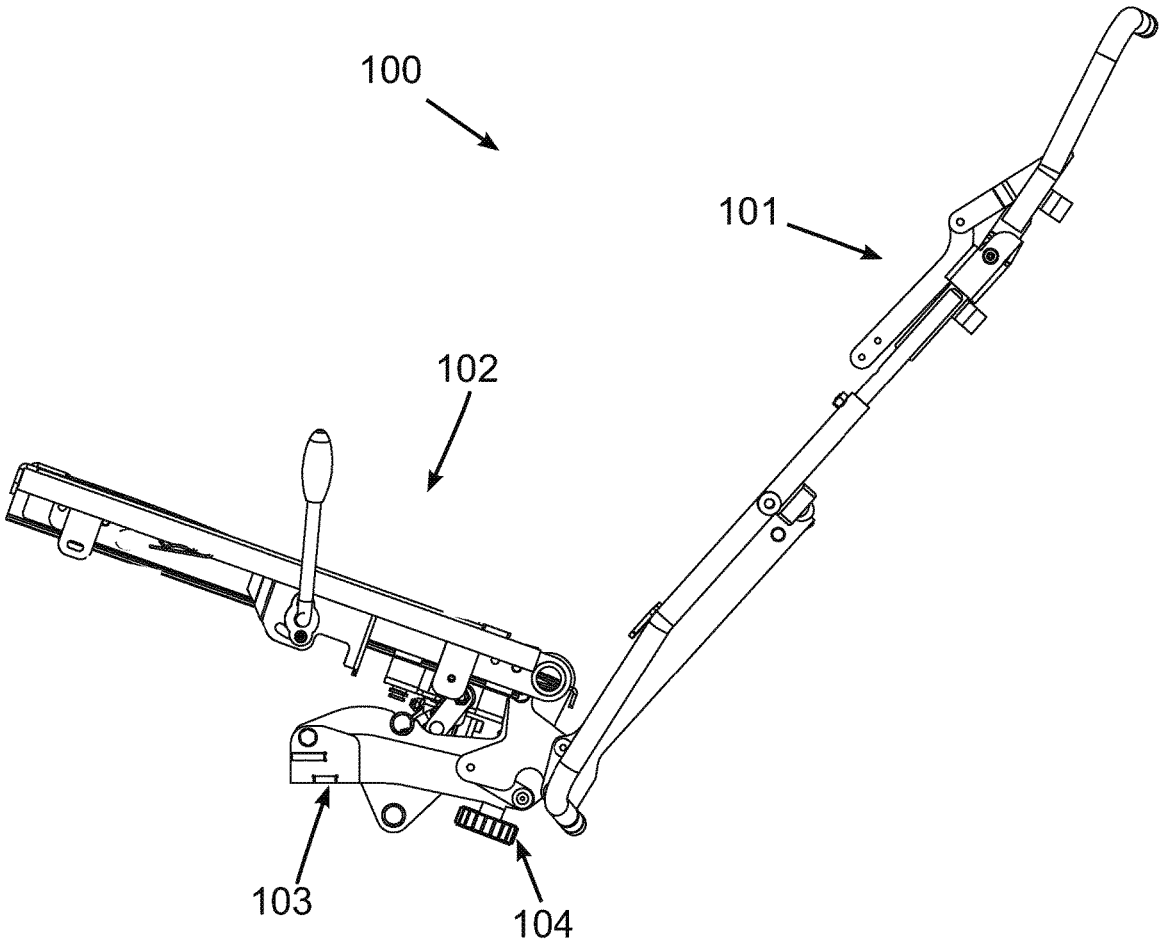
Figure 1E:
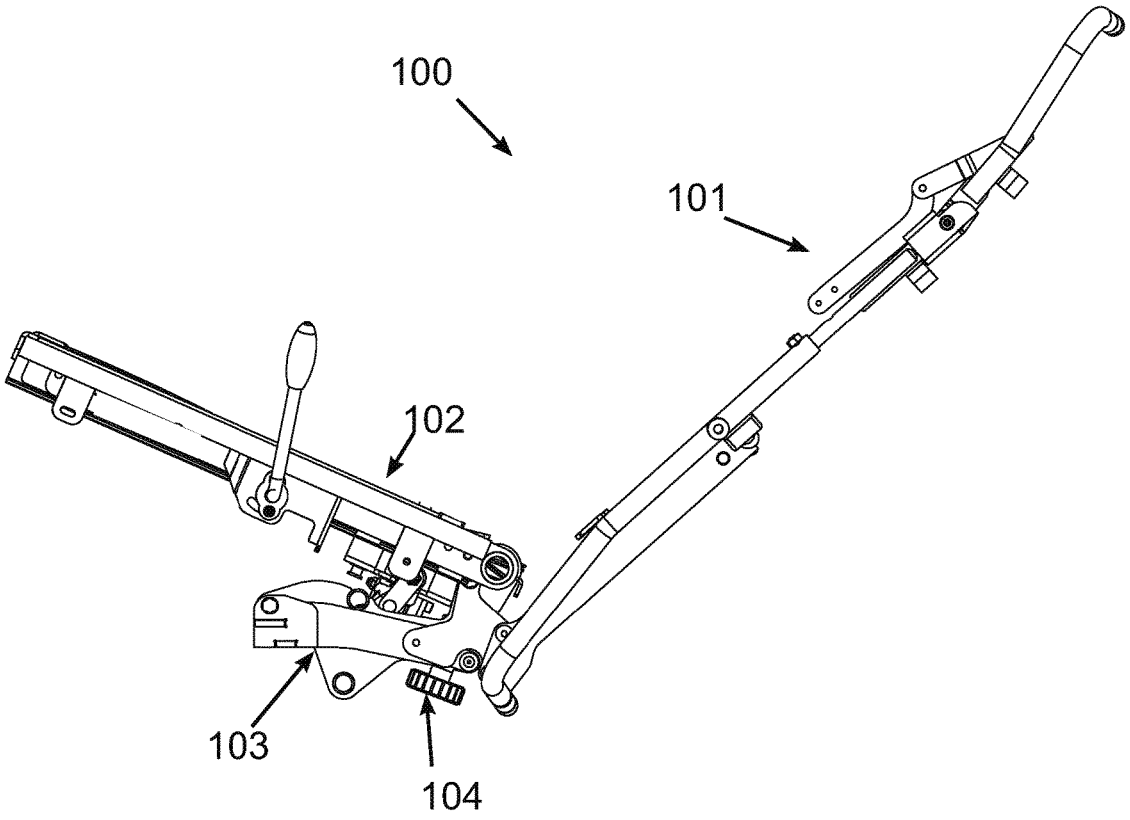

FIGS. 1A to 1B illustrate an item of seating furniture 100 with a backrest 101 and a seat surface 102. The backrest 101 is connected to the seat surface 102 via a linkage 103. A user can move the backrest 101 rearwards. This operation is illustrated in FIGS. 1A to 1E. In FIG. 1A, the backrest 101 is in a first position. In FIG. 1E, the backrest 101 is in a second position. The movement of the backrest 101 is converted via the linkage 103 into a movement of the seat surface 102. By means of this movement, the seat surface 102 changes its inclination relative to a supporting structure (not illustrated) to which both the backrest 101 and the seat surface 102 are fastened.

A resetting force acts on the backrest 101 in the direction of the first position. Said resetting force can be set by a gripping means 104.

Figure 2A:
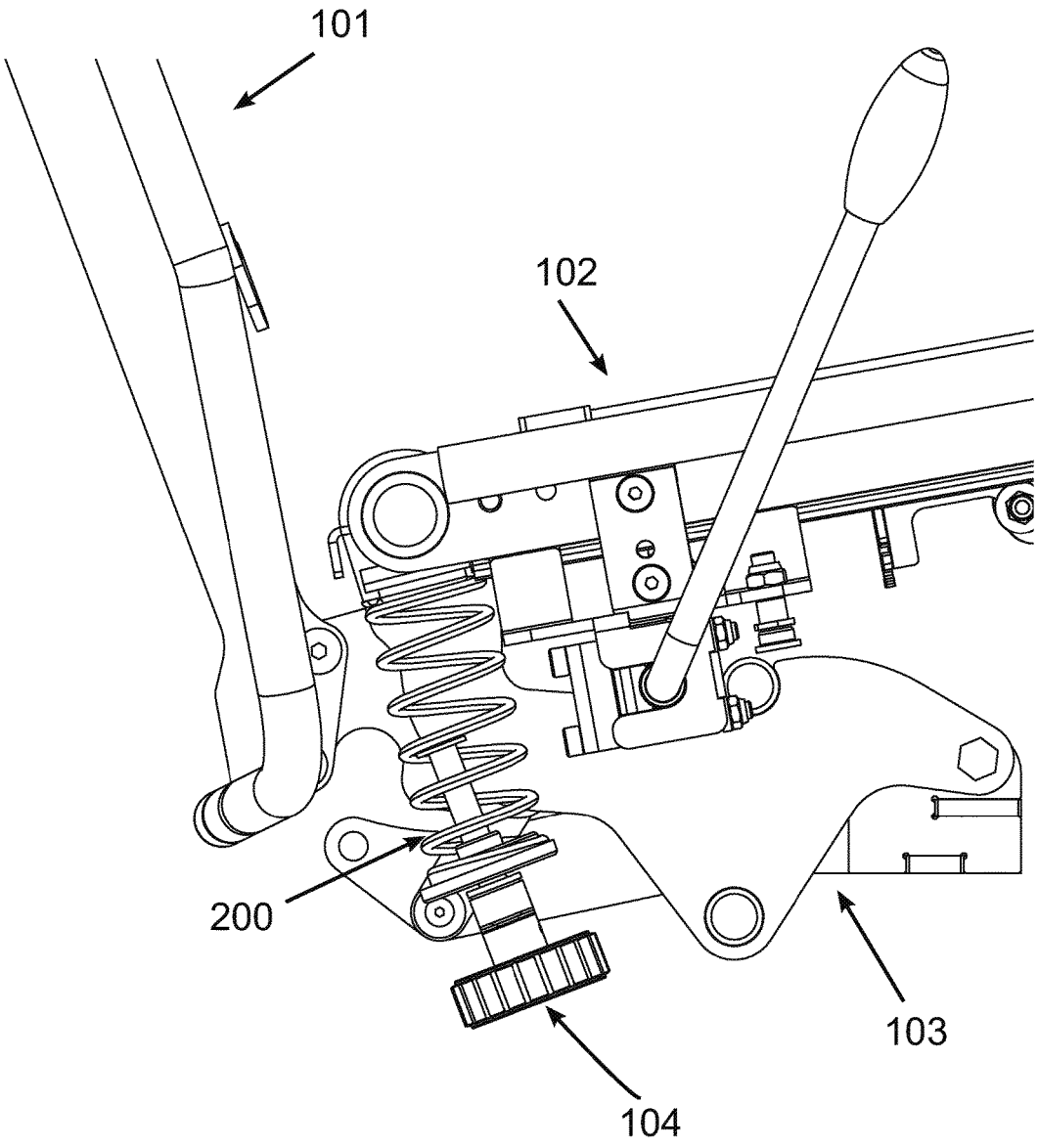
FIGS. 2A-2C show schematic illustrations of the resetting means and setting means in the case of an item of seating furniture according to one embodiment of the invention.
Figure 2B:
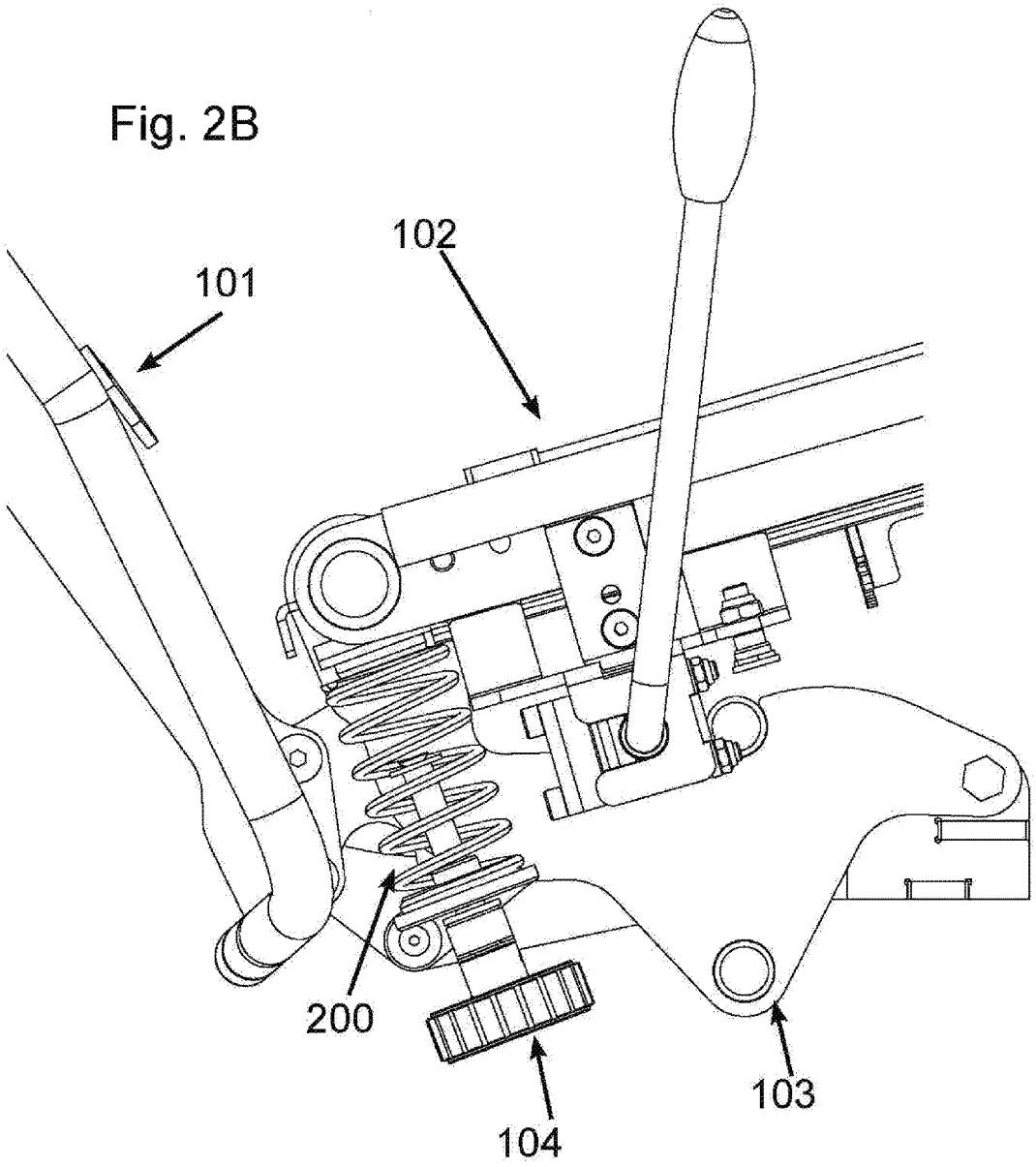
Figure 2C:
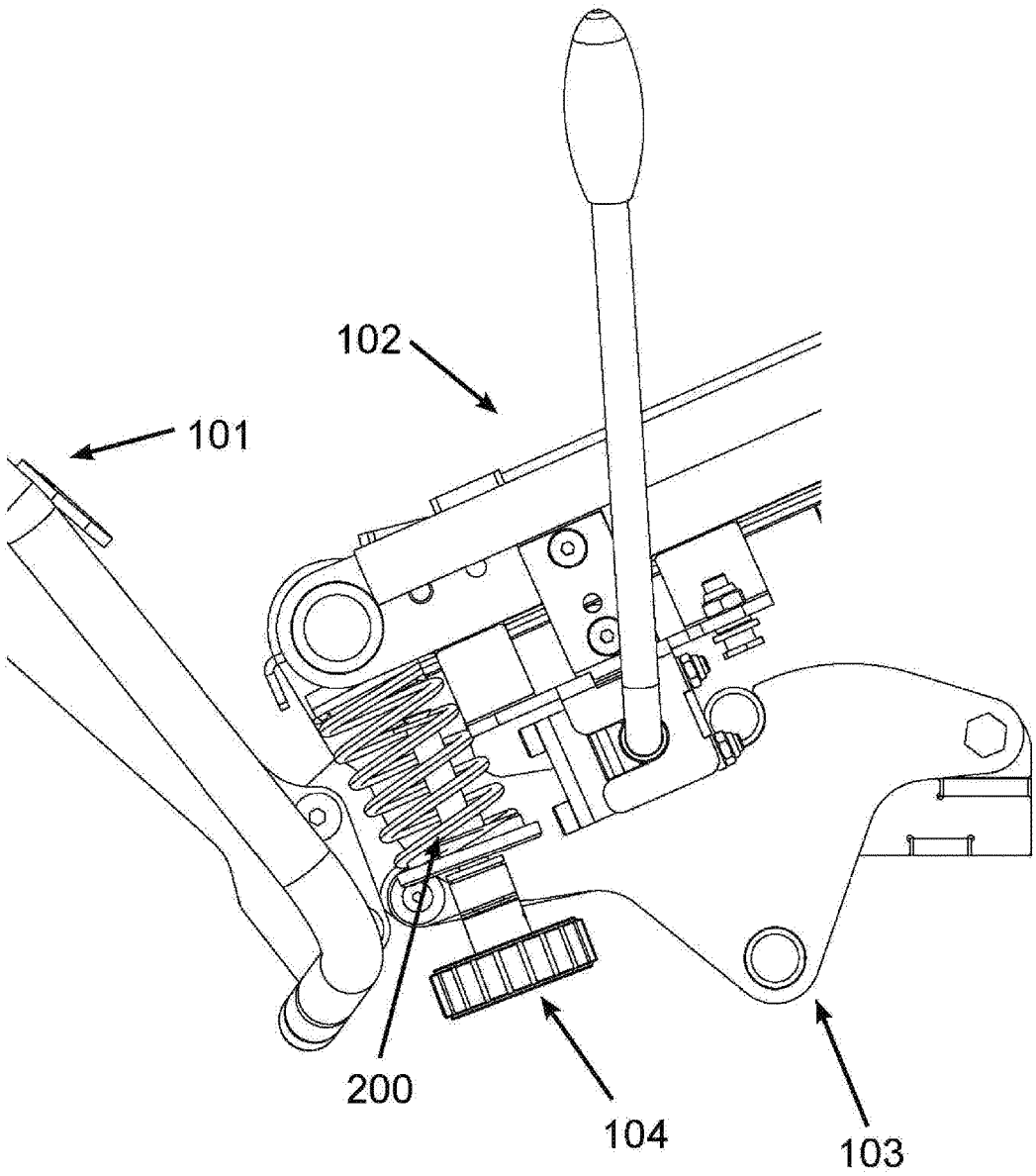

FIGS. 2A to 2C more clearly illustrate how the resetting force is produced and how it can be adjusted. A helical spring 200, which is supported at one end of the seat surface 102, is provided. When the backrest 101 is moved from the first position in the direction of the second position, the spring 200 is compressed. If force is no longer exerted on the backrest 101 by the user, the resetting force of the spring 200 moves the backrest 101 into the first position again.

The pretension of the spring 200 in the first position can be set by the gripping means 104. The gripping means can be screwed onto a threaded rod, as a result of which the spring is likewise compressed. The spring 200 has a progressive force increase. This means that the force which is required in order to deform the spring becomes greater the further the spring is compressed. This can be achieved, for example, by a conical spring shape or by a continuous change in the number of spring coils per length unit. Therefore, the further the gripping means 104 is screwed onto the threaded rod, the greater the force has to be in order to move the backrest 101. The resetting force can thus be set to the requirements of different users.

Figure 3:
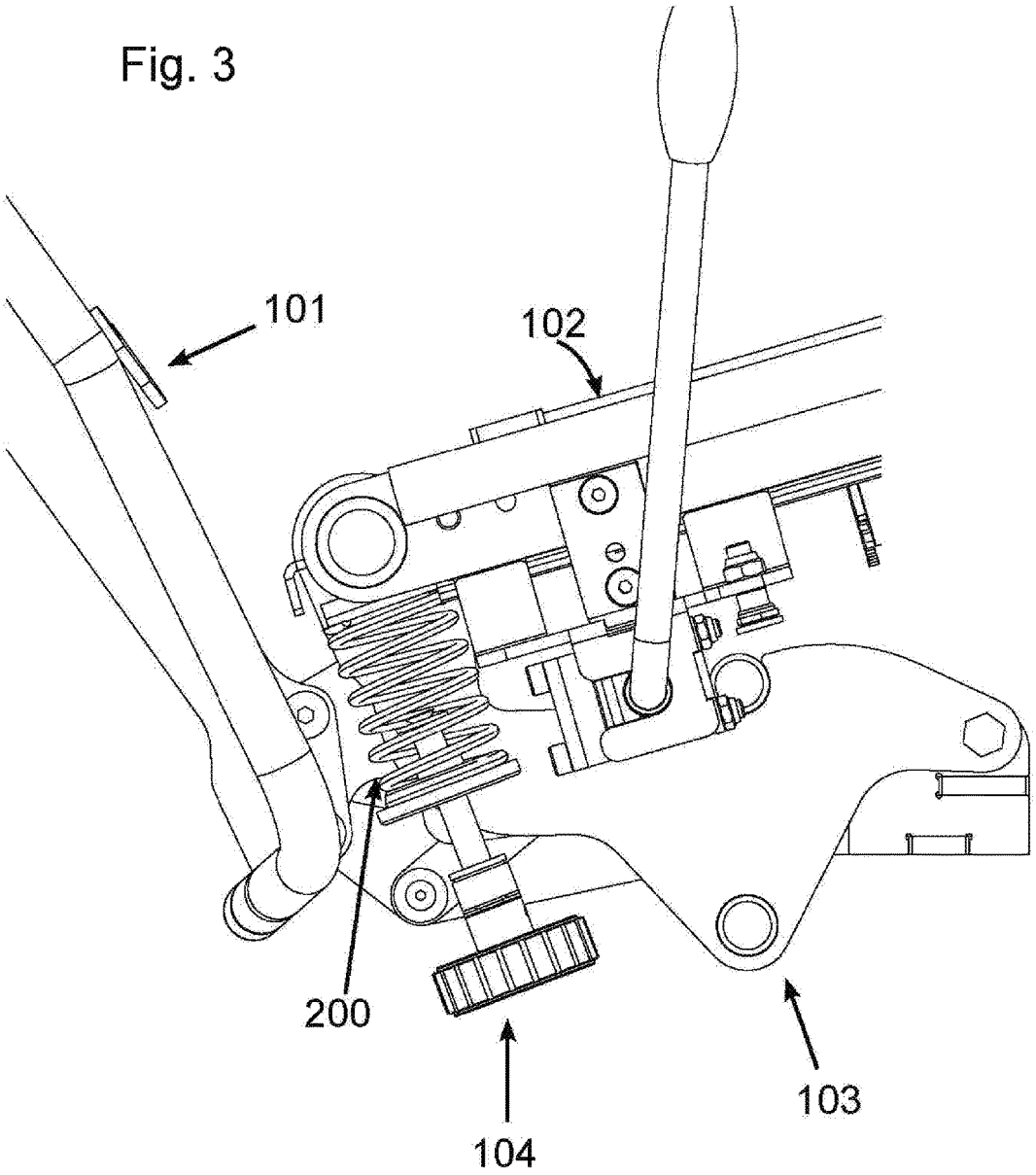
FIG. 3 shows a schematic illustration of the item, of seating furniture from FIG. 2 with differently set resetting means.

A comparison in FIGS. 3 and 2B makes it particularly clear how different resetting forces can be set. In the two figures, the backrest 101 is at the same angle with respect to the seat surface 102. However, in FIG. 3, the gripping means 104 is screwed further onto the threaded, red, and therefore the spring 200 is further compressed and a greater force is required for moving the backrest 101.

The invention claimed is:

1. An item of seating furniture (100), comprising:
- a backrest (101),
- a seat surface (102),
- a supporting structure and a resetting mechanism (200), wherein the backrest (101) and the seat surface (102) are connected to the supporting structure,
- wherein the backrest (101) is pivotable relative to the supporting structure about a pivot axis from a first position into a second position,
- wherein the backrest (101) is connected to the seat surface (102) via a connector (103), wherein the connector (103) is designed such that, when the backrest (101) pivots relative to the seat surface, the seat surface (102) is inclined relative to the supporting structure,
- wherein the resetting mechanism (200) is designed to exert a resetting force on the backrest (101) in the second position, said resetting force being directed in the direction of the first position, wherein the item of seating furniture (100) comprises a setting mechanism (104) which is designed to set the resetting force,
- wherein the resetting mechanism (200) comprises a spring (200), wherein the spring (200) is designed as a helical spring with a plurality of turns, the number of turns per length unit of the spring (200) is inconstant and/or the turns have different radii of curvature.

2. The item of seating furniture (100) according to claim 1, wherein the resetting mechanism (200) is supported on the seat surface (102) and is connected to the connector (103).

3. The item of seating furniture (100) according to claim 1, wherein the connector (103) comprises a linkage.

4. The item of seating furniture (100) according to claim 1, wherein the resetting mechanism (200) is designed to exert the resetting force on the backrest (101) during the entire pivoting operation of the backrest (101).

5. The item of seating furniture (100) according to claim 1 wherein the spring (200) has a pretension, and wherein the pretension is adjustable.

6. The item of seating furniture (100) according to claim 5, wherein the setting mechanism (104) comprises a threaded rod and a gripping device which is screwable onto the threaded rod, wherein the pretension is settable by the extent to which the gripping device is screwed onto the threaded rod.

7. The item of seating furniture (100) according to claim 6, wherein the threaded rod has a left-handed thread.

8. The item of seating furniture (100) according to claim 6, wherein the threaded rod has a trapezoidal thread.

9. The item of seating furniture (100) according to claim 1, wherein the number of turns of the spring (200) per length unit increases continuously from one end to another end of the spring (200).

10. The item of seating furniture (100) according to claim 1, wherein the radii of curvature increase continuously from one end to the other end of the spring (200).

11. The item of seating furniture (100) according to claim 1, wherein the resetting mechanism (200) is disposed vertically relative to the seat surface (102).

* * * * *